US005451059A

United States Patent [19]

Weis

[11] Patent Number: 5,451,059

[45] Date of Patent: Sep. 19, 1995

[54] GOLF SKILL DEVELOPMENT AND PRACTICE AID

[76] Inventor: Raymond P. Weis, 404 14th St. SE., Austin, Minn. 55912

[21] Appl. No.: 278,515

[22] Filed: Jul. 21, 1994

[51] Int. Cl.[6] ..... A63B 59/06

[52] U.S. Cl. ..... 273/185 R; 273/35 R; 273/200 B

[58] Field of Search ..... 273/184 R, 185 R, 185 D, 273/186.1, 197.4, 200 B, 35 R, 183.1

[56] References Cited

U.S. PATENT DOCUMENTS

| | | | |
|---|---|---|---|
| 1,581,402 | 4/1926 | Penfrare | 273/184 R |
| 1,881,991 | 10/1932 | Yaggi . | |
| 1,922,735 | 8/1933 | Johnson | 273/35 |
| 1,999,518 | 4/1935 | Stafford | 273/35 |
| 2,018,291 | 10/1935 | Thompson | 273/185 D |
| 2,039,633 | 5/1936 | Clark | 273/35 |
| 2,490,409 | 12/1949 | Brown | 273/35 |
| 2,656,720 | 10/1953 | Sonnett | 73/379 |
| 2,888,266 | 5/1959 | Melin | 273/35 |
| 3,107,919 | 10/1963 | Mackenzie | 273/185 R |
| 3,292,436 | 12/1966 | Bahnsen | 273/35 |
| 3,366,389 | 1/1968 | Murray | 273/200 B |
| 3,452,990 | 7/1969 | Nichols | 273/185 D |
| 3,790,176 | 2/1974 | Rietz | 273/200 B |
| 4,317,569 | 3/1982 | Kamitz | 273/200 B |
| 4,609,197 | 9/1986 | Vodin | 273/184 |
| 4,949,973 | 8/1990 | Williamson | 273/185 D |

FOREIGN PATENT DOCUMENTS

| | | | |
|---|---|---|---|
| 871857 | 5/1971 | Canada | 273/185 D |

*Primary Examiner*—Mark S. Graham
*Attorney, Agent, or Firm*—Moore & Hansen

[57] ABSTRACT

The present invention provides an apparatus for improving a golfer's skill at playing golf, the apparatus having a golf ball simulating target having a diameter substantially equal to the diameter of a real golf ball and means for supporting the target in a substantially upright orientation for striking by the golfer. Preferably, the means for supporting is formed of a material having shape memory retention properties such that the target will return to its rest position from its displaced position after being struck by a golf club. The supporting means is pivotally mounted to the surface to indicate direction of travel. The target may include an aperture to provide a whistle indicating a well hit golf ball and the apparatus may include a distance indicator.

17 Claims, 4 Drawing Sheets

GOLF SKILL DEVELOPMENT AND PRACTICE AID

FIELD OF THE PRESENT INVENTION

The present invention relates in general to apparatus for improving the skills and scores of golfers and in particular to a readily portable, easily useable apparatus that a golfer may use in practice and/or warmup that provides directional and auditory indications of a well hit golf ball, as well as shows whether a hit ball would hook or slice.

BACKGROUND OF THE PRESENT INVENTION

A variety of golfing devices or toys related thereto can be found in a survey of the prior art. For example, such devices can be found in U.S. Pat. Nos. U.S. Pat. No. 1,881,991 to Lawrence E. Yaggi; U.S. Pat. No. 1,922,735 to Charles H. Johnson; U.S. Pat. No. 1,999,513 to John K. Stafford; U.S. Pat. No. 2,039,633 to Luther I. Clark; U.S. Pat. No. 2,490,409 to Paul H. Brown; U.S. Pat. No. 2,656,720 to Frederick W. Sonnett; U.S. Pat. No. 2,888,266 to Arthur K. Melin; U.S. Pat. No. 3,292,436 to Robert G. Bahnsen; and U.S. Pat. No. 4,609,197 to George M. Vodin.

The Yaggi U.S. Pat. No. '991 discloses a golf practice device that includes a rectangular mat having a rectangular slot. A target made of a flexible rubber material having a head in the form of a golf ball is mounted on a neck and is supported in the slot. The neck is split into two halves by a slot, each half having a strip of tin or other material imbedded therein. The neck is inserted in the slot and the neck halves are bent in opposite directions so as to be received within slots disposed in the underside of the mat. Yaggi U.S. Pat. No. '991 alleges that this device possess enough resilience to be struck and then return to an upright position after being struck.

The Johnson U.S. Pat. No. '735 patent discloses a golf practice device in two embodiments. The first embodiment is simply a pair of circular sections connected by a strip that is stamped out of thin sheet metal or the like and which may be painted white or covered with fabric or similar material. The device is bent at fight angles so as to present an tipright target. The second embodiment comprises two circular discs. One disc has a pair of tabs that are received by a slot in the other disc and then bent in opposite directions. The discs may be placed at right angles to each other so as to form an upright target.

The Stafford U.S. Pat. No. '513 patent discloses a golf apparatus comprising a base having sloping side walls that form a channel that receives a tubing. The tubing is made of a flexible resilient material and is substantially as long as the channel formed by the side walls. A leather strip extends out of an end of the tube, an end of strip being fastened to a golf ball. The other end of tubing includes a directional arrow useful for indicating direction of travel of golf ball when struck. When the golf ball is struck the tubing is forced in the direction of travel of ball thus uncovering the distant indicators placed into the bottom of the channel formed by side walls. Since the apparatus is anchored by a stake, the apparatus will turn in the direction of travel of the golf ball thus giving an indication of the amount of hook or slice.

The Clark U.S. Pat. No. '633 patent discloses another golf practice device that includes a ball or target mounted on a base to a flexible stem. Striking the ball with a golf club results in the deformation and elongation of the stem and ball in the direction of flight. The patent further discloses apparatus claiming to provide indications of a slice or a hook shot as well as a distance.

The Brown U.S. Pat. No. '409 patent discloses a golf practice device comprising a target mounted to a base. The base may take a variety of forms and includes an anchor spike attached directly thereto.

The Sonnett U.S. Pat. No. '720 patent discloses a golf practice apparatus including a golf ball or target mounted to a coil spring secured to an arcuate shell that is attached to a base. A cable is attached to the ball and extends through the coil spring and around a small pulley disposed with the arcuate shell and then rearwardly around a small pulley, upwardly to a small pulley and forwardly from there to a distance indicator. Thus striking the ball results in the distance indicator being moved rearwardly to indicate approximate distance. To indicate whether a golfer has hit a hook or a slice a visual indicator is provided including a pair of lamps that are attached to a circuit. As the ball is struck it will be displaced forwardly and engage a switch lever thus causing a closed circuit on one side of the circuit and thereby indicating a hook or a slice. If the ball is hit on a true line neither side of the circuit will be closed thus resulting in no light being illuminated and an indication that the ball has been properly hit.

The Melin U.S. Pat. No. '266 patent discloses a golf practice device that includes a golf ball shaped target attached an arm that is engaged at its other end to a support, which includes a pair of spikes by which it may driven into the ground. The support includes a slot that receives a key portion of an arm. The arm is flexible such that it may be displaced when the target is struck.

The Bahnsen U.S. Pat. No. '436 patent teaches a frame supporting a golf ball target. The ball is connected through mechanical means to a revolution counter to provide an indication of distance.

The Vodin U.S. Pat. No. '197 patent discloses a golf practice device and includes a golf ball mounted to a shock cord that in turn is secured to a conical head of a stake. Also associated with the apparatus is a distance indicator that includes an indicator slide attached to a helical spring. A cord passes through the center of the spring and is attached to a shock cord such that when the ball is struck by a golf club, the cord will be pulled outwardly, thus moving the distance indicator slide against spring 6 to provide an indication of distance.

Each of the foregoing patents teach a mechanism for indicating either distance or direction of travel or both in some circumstances. The foregoing disclosed devices are deficient, however, in that they do not teach any auditory mechanism for indicating a properly hit golf ball. Furthermore, several of the devices are quite large and incapable of ready portability, a feature often desired by golfers who may play on many different courses and at many different practice facilities. Some of the devices provide for the target automatically returning to a hittable position after being struck by a golf club while others do not.

It would be desirable to have a readily portable golf skill development and practice aid that could withstand the rigors of being struck with the great force of a golf club repeatedly over the aid's lifetime. In addition, it would be desirable to have a golf aid that would indicate direction of travel, distance of travel, and provide an auditory indication of a well hit golf ball while maintaining its ready portability and life expectancy. It would also be desirable to have a golf aid of the foregoing types that incorporated shape retention materials to return the golf target to a hittable, upright position after being struck by a golf club.

SUMMARY OF THE INVENTION

It is an object of the present invention to provide new and improved apparatus that is not subject to the foregoing disadvantages.

It is another object of the present invention to provide apparatus that will aid a golfer in developing golfing skills.

It is still another object of the present invention to provide apparatus that will facilitate a golfer in warming up before playing.

It is yet another object of the present invention to provide apparatus that will enable a golfer to simulate a variety of strokes.

It is still yet another object of the present invention to provide apparatus that will provide a golfer with an indication of travel of a real ball.

It is another object of the present invention to provide a golfer with apparatus that will provide an audible indication of a properly struck ball.

It is still another object of the present invention to provide a golfer with a readily portable skill development and practice aid.

It is yet another object of the present invention to provide a golfer with an indication of distance that a ball would travel.

The foregoing objects of the present invention are provided by an apparatus for improving a golfer's skill at playing golf, the apparatus having a golf ball simulating target having a diameter substantially equal to the diameter of a real golf ball and means for supporting said target in a substantially upright orientation, the means for supporting including first and second portions disposed substantially at a right angle to each other with the first portion being disposed substantially flush with a practice surface and the second portion extending away from the surface and supporting the target away therefrom. The first and second portions are joined at a flexible hinge such that upon the target being struck by a golf club the target will be moved from a rest position to a displaced position. Preferably, the means for supporting is formed of a material having shape memory retention properties such that the target will return to its rest position from its displaced position after being struck by a golf club.

In one embodiment of the present invention the apparatus may have means for providing an auditory signal indicating when the target has been properly struck by a golfer with a golf club. In another embodiment, the apparatus may have means for indicating direction of travel that may be means for anchoring the apparatus to the surface such that the supporting means is free to rotate about a predetermined pivot point from the rest position to a rotated displaced position upon said target being struck by a golf club, wherein the rotated displace position indicates direction of travel.

The foregoing objects of the invention will become apparent to those skilled in the art when the following detailed description of the invention is read in conjunction with the accompanying drawings and claims. Throughout the drawings, like numerals refer to similar or identical parts.

BRIEF DESCRIPTION OF THE DRAWINGS

FIG. 8 is a front elevation, cross section view of the apparatus shown in FIG. 6 taken along cutting plane 8—8 thereof.

DETAILED DESCRIPTION OF THE INVENTION

Figure 1:
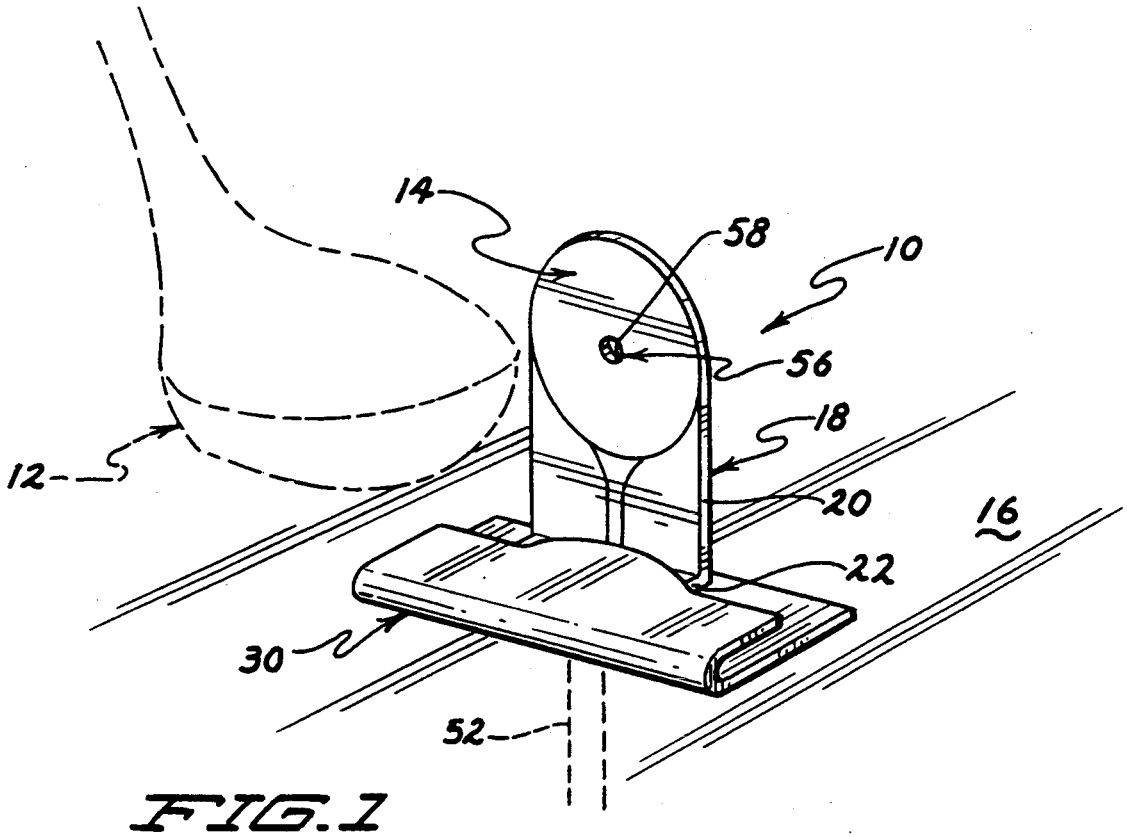
FIG. 1 is a perspective view of an embodiment of the present invention with a golf club head shown in phantom outline.

A first embodiment of the present invention is illustrated in FIGS. 1–4. FIG. 1 shows a perspective view of one embodiment 10 of the present golf aid invention with a golf club head 12 shown in phantom outline relative thereto. As illustrated therein, a golf skill aid 10 in accord with the present invention includes a target 14. Target 14 as shown in the Figure is substantially disk-like and has a diameter substantially equal to a regulation golf ball. Thus, target 14 comprises a golf ball simulating target having a substantially circular configuration. Target 14 is supported above the mounting surface 16 by an L-shaped or right angle support 18. Support 18 includes a first arm 20 and a second arm 22 disposed substantially at right angles to each other. Arms 20 and 22 have substantially planar configurations. Target 14 may be formed integral with and from the same material as right angle support 18, or it may be formed from a separate material and adhered to upright first arm 20. A simulated golf tee 23 is shown disposed on the first arm 20.

Figure 2:
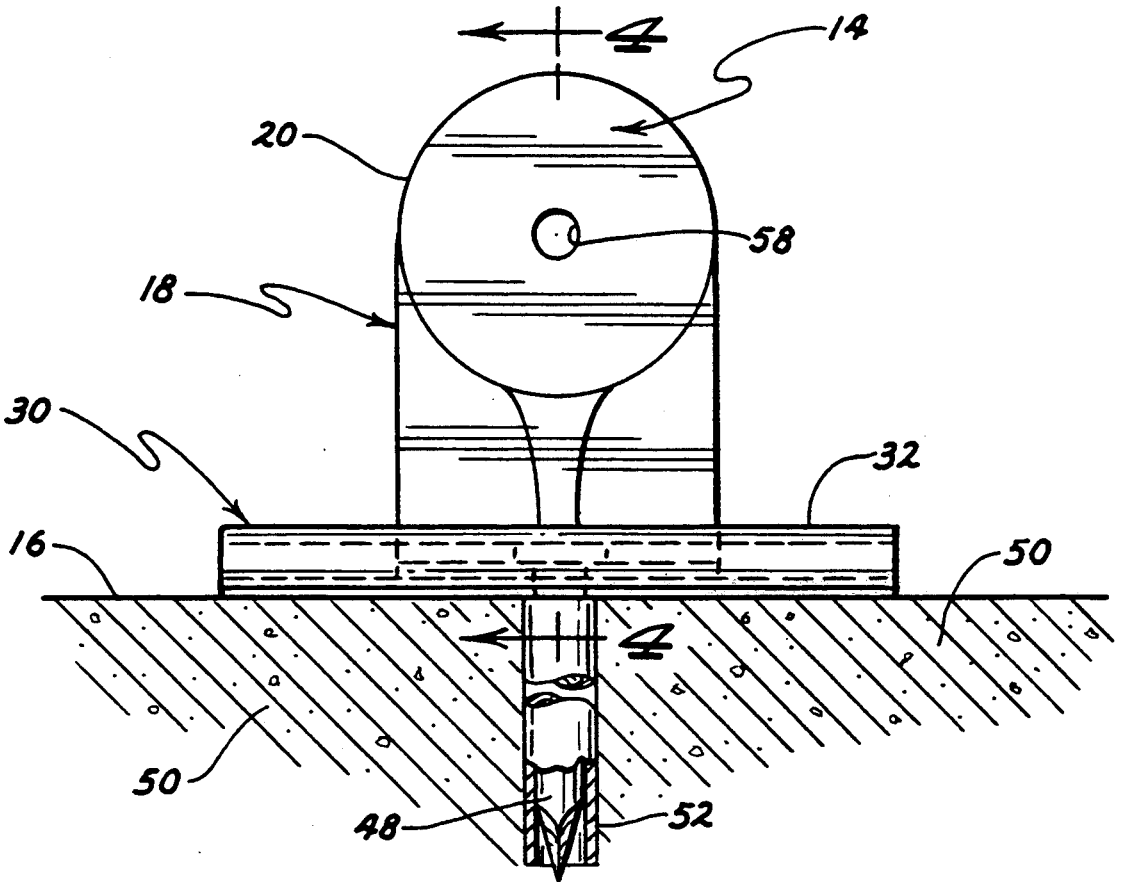
FIG. 2 is a side elevation, cross section view of the apparatus shown in FIG. 1 showing the target in its rest position and in phantom outline in its displaced position.

FIG. 1 illustrates the present invention 10 relative to an approaching golf club head 12 as previously noted. FIG. 2 illustrates golf aid 10 in a side elevation cross sectional view. First arm 20 is shown cross sectioned and in an upright first, or hittable, position 24 and in a second position 26 that is forwardly displaced from the first position. As seen there, first arm 20 is curvingly bent forward from its flexible hinge or juncture 28 with second arm 22 to assume the second forwardly displaced portion 26 as a result of being struck by the club head 12.

Support 18 is preferably formed from a shape memory type so that when first arm 20 is struck by a golf club and moved forwardly thereby to the second position 26, it will return to its first, upright position 24 to be struck again. It must be able to retain its memory of its rest position through repeated, violent blows from the golf club head. Since a golf club head can be moving with substantial velocity, the force with which first arm 20 is struck can be substantial. It is imperative therefore that support 18 also be formed from a material capable of withstanding repeated blows over a wide variety of temperatures. Preferably, support 18 is made out a material such as polyester urethane thermoplastic elastomer T.P.U., sold as Goodrich estane 5707, which the Applicant has found meets the aforegoing operational requirements.

Figure 4:
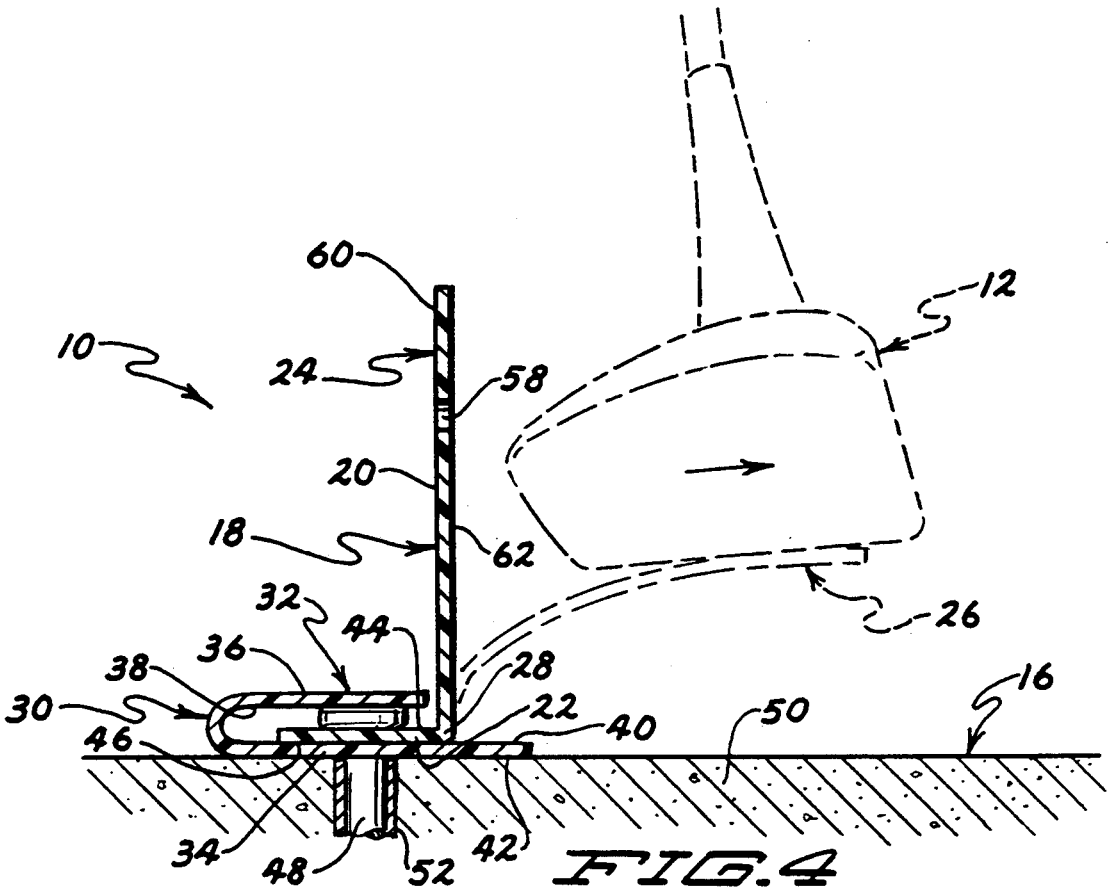
FIG. 4 is a front elevation view of the apparatus shown in FIG. 1.
Figure 3:
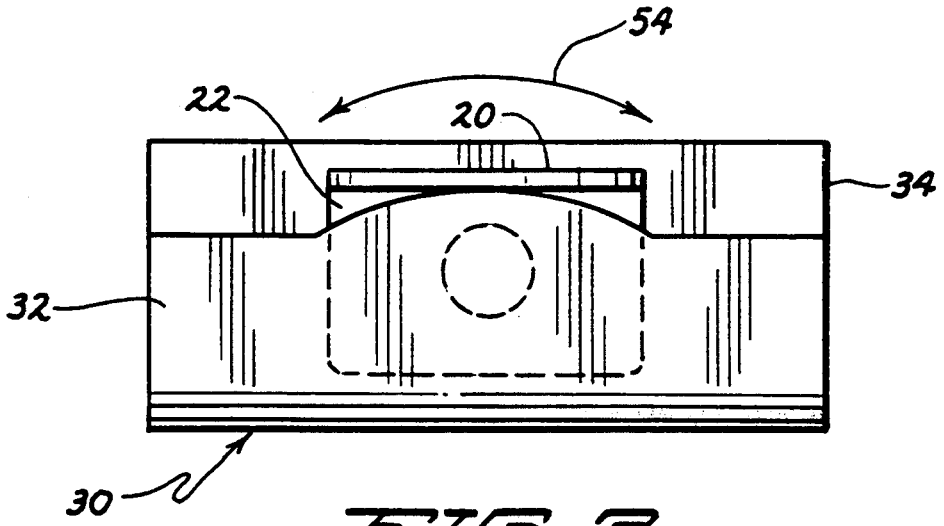
FIG. 3 is a top elevation view of the apparatus shown in FIG. 1.

Referring now to FIGS. 2 and 4 in particular, it can be seen that the present invention includes a collar 30 comprising a substantially U-shaped member in cross section. The second arm 22 is received between the two collar arms 32 and 34 as best seen in FIG. 2. That is, collar arm 32 has a top and bottom surfaces 36 and 38 respectively and collar arm 34 has top and bottom surfaces 40 and 42 respectively. Second arm 22 is received between collar arms 32 and 34 such that the top surface 44 of second arm 22 engages the bottom surface 38 of collar arm 32 and the bottom surface 46 of second arm 22 engages the top surface of collar arm 34.

Collar 30 may be formed from the same flexible material as support 18 if desired and thus may initially comprise a planar piece of material bent over upon itself into the configuration shown in the Figures and the free ends thereof attached. Or if desired, collar 30 may be injection molded or otherwise manufactured from a thermoset or thermoplastic material having rigid configuration similar to that shown. It is preferable, however, to retain some flexibility since golf club heads will often strike collar 30 and it is preferable that the club heads not be damaged as a result. In addition, with a flexible collar when a club head does strike the collar, the flexible nature thereof will absorb some of the force and help prevent the strike thereon from dislodging the golf aid 10 from the ground. A further desirable feature of having collar 30 formed of a flexible material is that the lower surface 42 of second collar arm 34 will facially engage mounting surface 16. Since the golfer will often be using the golf aid 10 on a variety of surfaces, few of which will be planar in nature, manufacturing collar 30 out of a flexible material will allow the second arm 34 to assume the same surface as the mounting surface.

Golf aid 10 is held in a predetermined position by a stake 48 or similar means. Stake 48 extends through appropriately configured through holes in second arm 22 of support 18 and second collar arm 34 of collar 30 into the ground 50. As best seen in FIGS. 1 and 4, stake 48 will extend through a sleeve 52 and will be free to rotate relative thereto. Thus, as seen in the top plan view of FIG. 3, golf aid 10 is free to rotate either clockwise or counterclockwise relative to sleeve 52 as indicated by double headed arrow 54 when target 14 (or first arm 20) is struck by a golf club head 12. This rotation of support 18 provides an indication of the direction a real ball would travel if it were hit by an actual golf club and thus provides an indication of direction to the golfer. Stated otherwise, stake 48 comprises a means for anchoring golf aid 10 to the surface 16 such that the support 18 is free to rotate about a predetermined pivot point, which may be the stake 48 or some other predetermined point, from a rest position to a rotated displaced position upon the target being struck by a golf club. This rotated, displace, position indicates direction of travel had a real golf ball been struck.

A further exemplary feature of the present invention can be seen by referring to the foregoing discussed Figures and the following discussion. Thus the golf aid 10 in accord with the present invention includes an auditory indicator 56. Indicator 56 as shown comprises a through an aperture or hole 58 extending between opposing stirfaces 60 and 62 of first arm 20. In particular, indicator 56 is preferably disposed substantially centrally of the golf ball-shaped target 14 where the "sweet spot" of an actual golf ball would be located. As is well known, striking a ball at the sweet spot generates the greatest distance and truest direction for any particular strike. Thus, when a golf club head 12 strikes target 14 properly, air will be forced through the through hole 58 at a high velocity, thereby generating an audible whistling sound. When the golfer hears this audible sound, the golfer will know that the ball has been properly struck such that had a real golf ball been struck, a real golf ball would have travelled far and straight ahead.

The presently described embodiment 10 of a golf aid in accord with the present invention provides ready portability for the golfer. The aid 10 is fairly small in size. Due to the flexibility of the first and second arms 20 and 22 respectively at their juncture 28 with each other, the first arm 20 can be folded from the first upright position 24 to the second displaced position 26 (or if desired, can be folded in the other direction) so as to present a substantially flat arrangement providing for ease of carrying. Stake 48 can be made removable if desired so that the entire aid 10 can be stowed in a very small space, thereby making it easily carryable in a conventional golf bag. The aid 10 can provide many years of use due to the extended lifetime of the material used to form support 18. The free rotation of the stake 48 within sleeve 52 enables the golfer to know when he is properly addressing a golf ball and is especially valuable for the infrequent golfer who, because of lack of time or resources now fails to warm up properly before playing a round of golf, will learn before his first shot whether he is lining up properly. The present invention also advantageously furnishes the golfer with the aforementioned auditory signal, thereby providing a further sensory indication of a well or properly hit golf ball.

Simulated tee 23 may be formed from a rubberized paint applied to the first arm 20. Using such a material will prevent the tee 23 from cracking as the first arm 20 is bent under the force of an impact from the golf club head 12. The material forming the support 18 will preferably be clear or see-through except for the tee, which can be made in a variety of colors as are real golf tees. The target ball 14 may be hologrammed on the first arm 20 in white, yellow, orange, or any other color desired. Together, the tee 23 and the target ball 14 will provide a simulation of a real ball on a real tee being presented to the golfer. Furthermore, like real tees, first arm 20 can be sized in the vertical dimension at a plurality of heights so as to simulate the variety of heights at which golfers place tees on a course or driving range.

Figure 5:
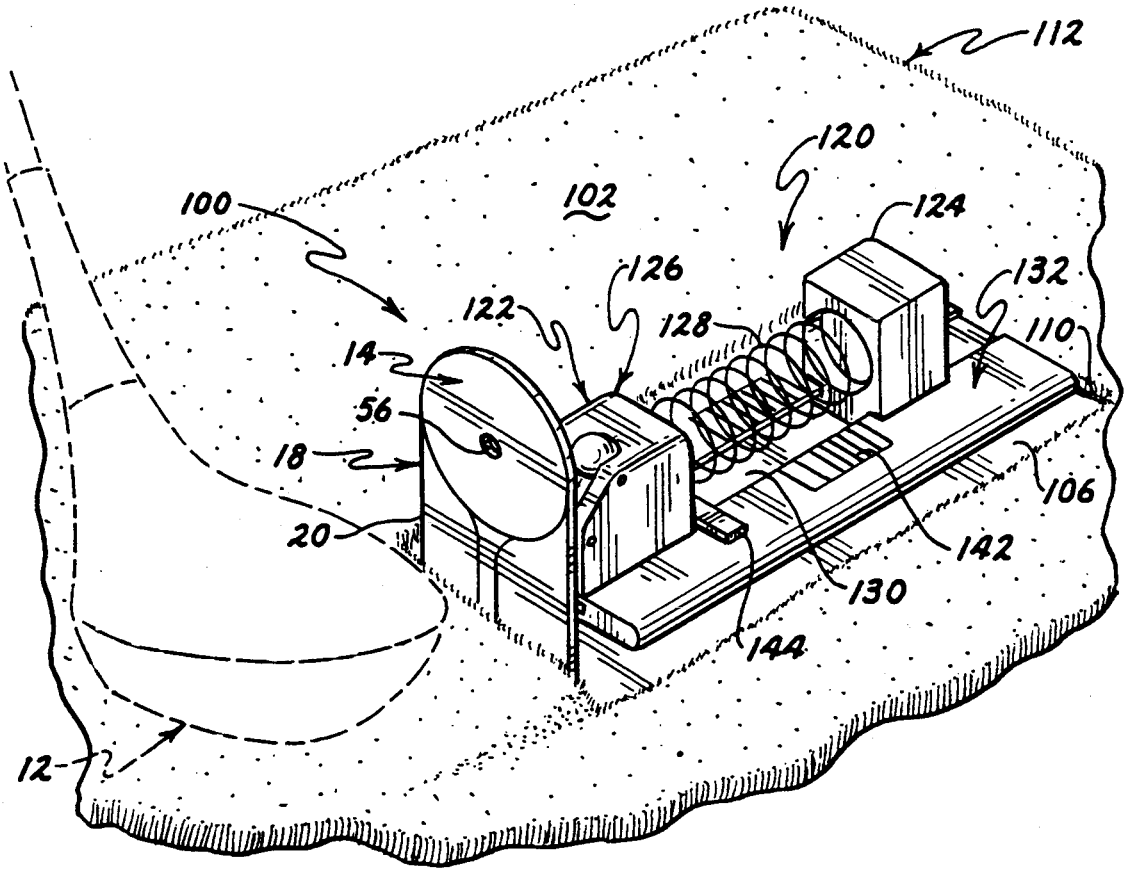
FIG. 5 is a perspective view of another embodiment of the present invention.
Figure 6:
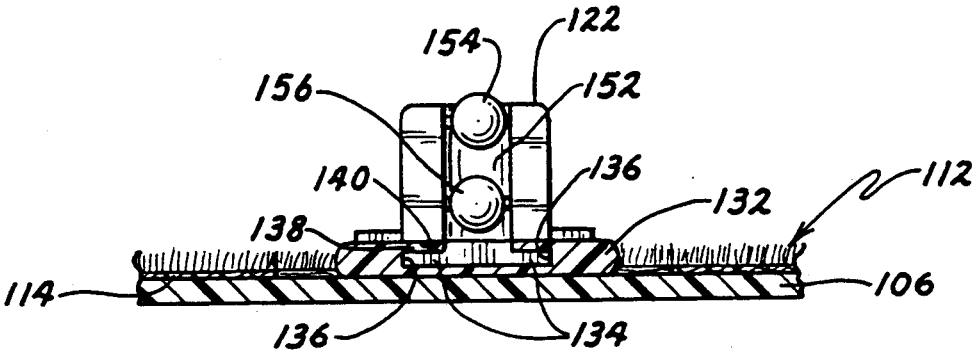
FIG. 6 is a side elevation view of the embodiment of the present invention illustrated in FIG. 5.
Figure 7:
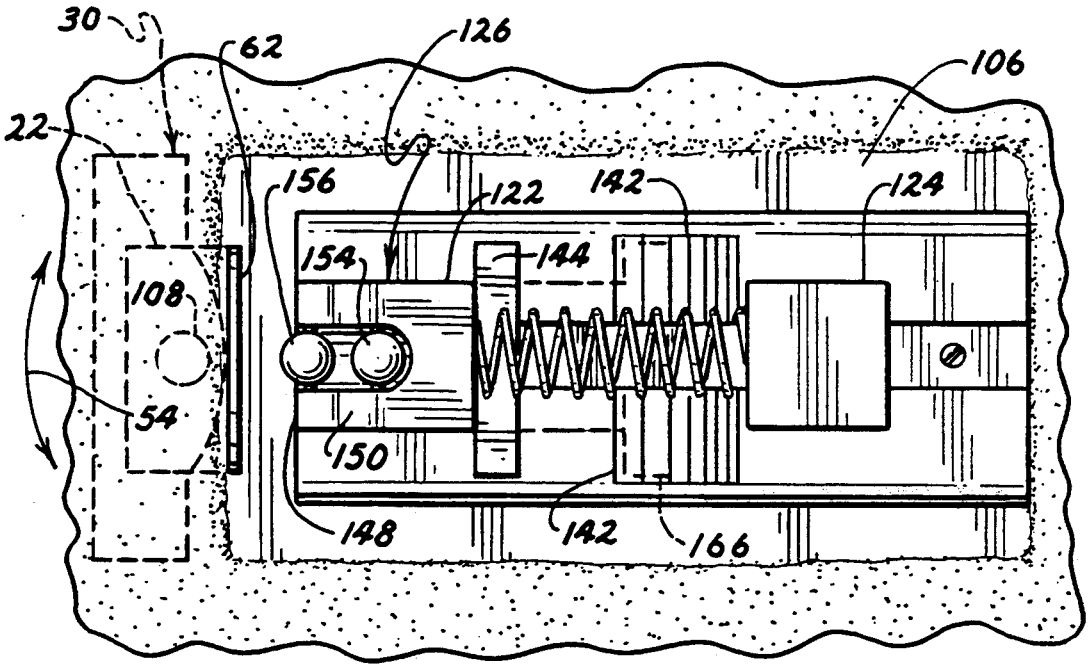
FIG. 7 is a top plan view of the embodiment of the invention depicted in FIG. 5.
Figure 6:
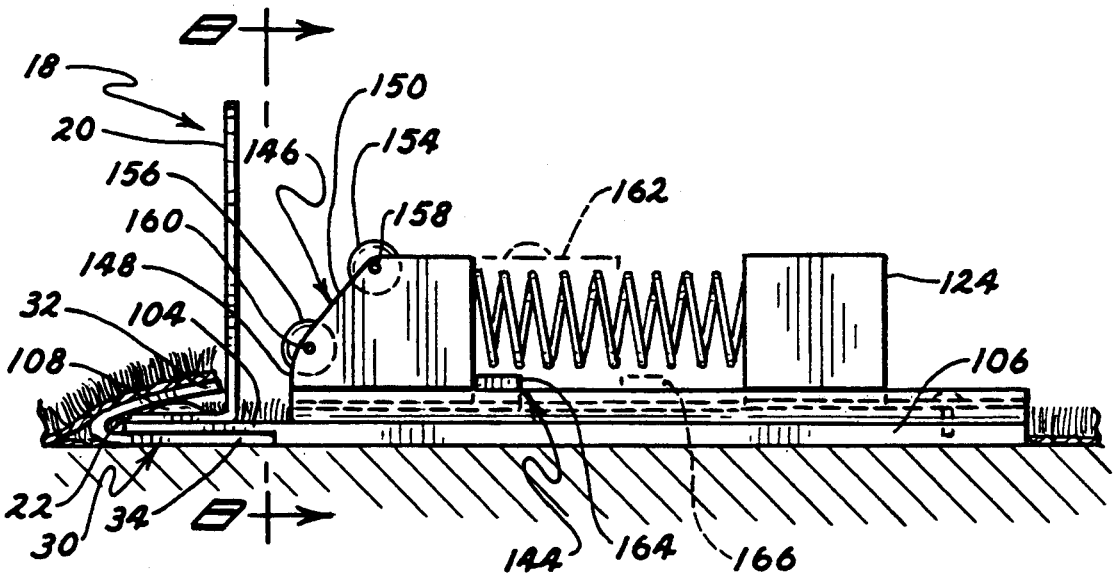

An alternative embodiment of the present invention will be described with reference to FIGS. 5–8. Thus, these Figures show a golf aid 100 in accord with the present invention relative to a golf club head 12 positioned to strike a target. Many of the features of golf aid 100 are similar or identical to those of aid 10 and thus like reference numerals will be used to designate those similar features. Golf aid 100 includes a target 14 elevated above the mounting surface 102 by a support 18 that includes first and second arms 20 and 22 respectively, the first arm including a simulated tee 23. Support 18 is also preferably manufactured from polyester urethane thermoplastic elastomer T.P.U., sold as Goodrich estane 5707. Second arm 22 is received by a collar 30 having a U-shaped configuration and including first and second collar arms 32 and 34. Collar 30 also sandwiches between collar arms 32 and 34 a rearwardly extending segment 104 of a base 106 to be hereafter described, as best seen in FIG. 6. A fastener 108 extends through second support arm 22, rearwardly extending segment 104 and second collar arm 34, thereby anchoring the support 18 to the base 106. As seen in FIG. 5, base 106 may be disposed within a cut-out portion 110 of a mat 112 of carpet or artificial turf. As shown in the Figures, base 106 extends under mat 112 on all sides of cut-out portion 110 and may be anchored to the backing 114 of the mat 112 by adhesives or other known means. Target 14 includes an auditory indicator 56.

Golf aid 100 further includes a distance indicator 120 to be described hereafter. Distance indicator 120 includes a sliding member capable of being disposed relative to target 14 such that when the sliding member is in a rest position it can be struck by the target 14 when the target is moved from its target rest position 24 to a target displaced position 26. Distance indicator 120 includes a rearwardly disposed, movable target engagement block 122 and a forwardly disposed, stationary block 124. Stationary block 124 is fixed to platform 132 so as to be non-moving relative thereto. Thus, golf aid 100 includes a mounting plate or platform 132 that extends longitudinally away from the target 14 in the direction of movement of the target 14 from its rest position 24 to a displaced position 26. Movable block 122 is biased into a rest position 126, seen in FIGS. 5–7, by a compression spring 128. That is, one end of spring 128 is attached to block 122 and the other end is attached to block 124. Movable block 122 slidingly engages a track 130 formed into a platform 132 affixed to base 106. Platform 132 and track 130 comprise a slide frame for the sliding movement of the slidable block 122. As best seen in FIG. 8, the sliding engagement between block 122 and platform 132 is in the form of a tongue and groove configuration. That is, block 122 includes a pair of tongues 134 extending outwardly therefrom in opposing directions with each tongue slidingly engaging a groove 136 formed in the platform 132. Block 122 further includes grooves 138 disposed above tongues 134 that slidingly receive a tongue 140 formed in platform 132.

As shown, platform 132 has an elongate configuration and a cross section that is substantially rectangular, though the present invention contemplates other configurations as well. Platform 132 includes a distance scale 142 for the indication of a hit golf ball as will be explained now. Thus, sliding block 122 includes an indicator 144 freely engaging the forward side thereof. Thus, as block 122 moves towards block 124 it will push indicator 144 forwardly toward block 124 and thus toward distance scale 142. Because indicator 144 is not attached to block 122, it will not move rearwardly with the block 122 when the spring 128 pushes it rearwardly. Indicator 144 is thus preferably mounted for sliding movement within track 130 and may use a tongue and groove slidable mating arrangement identical to that of sliding block 122, as seen in FIG. 6. Other apparatus useful for allowing sliding movement between two relatively movable members such as platform 132 and block 122 on one hand and platform 132 and indicator 144 on the other hand may also be used with the present invention.

Referring now to FIG. 8, it can be seen that the rearward face 146 of block 122 has an upright planar portion 148 and a slanted planar portion 150. Slanted portion 150 includes a groove 152 in which two rollers 154 and 156 are mounted for rotation by axles 158 and 160 respectively. Rollers 154 and 156 facilitate a smooth swing by the golfer and reduce the potential for injury to either golf aid 102, club head 12 or to the golfer as will be explained.

As club head 12 strikes target 14, first arm 20 will be displaced from its rest position to a displaced position as described with reference to FIGS. 1–4. The rear surface 62 of first arm 20 will be forced into engagement with the rearward face 146 of block 122 as the club is swung through its normal arc. The club head 12 will still be engaging the target 14 as the rear surface 62 engages the rearward face 146 and thus the club head will exert a force directly onto block 122. This force will act against the biasing force of compression spring 128, causing compression spring 128 to compress and forcing block 122 to slide forwardly relative to platform 132. This sliding movement will force indicator 144 to slide forwardly also, thereby providing an indication of distance had a real ball been struck rather than target 14. As the club head 12 bears against target 14 and thus block 122, the surfaces of rollers 154 and 156 will be engaged by the rear surface 62 of target 14. The rollers will rotate under the impact of the club head 12 and therefore simulate the rotation of a real golf ball upon impact by a club head. This rotation of rollers 154 and 156 will therefore provide some freedom for the target rear surface 62 to slidingly engage the rearward face 146 of bloc 122 and thereby avoid a non-sliding engagement between the aforementioned surfaces. Were a completely non-sliding engagement to occur, the club head 12 or golf aid 100 may be damaged since such an engagement would be similar to striking the club against a solid object.

Referring to FIG. 6 it will be seen that block 122 is shown in its rest position 126 and in phantom in a position 162 displaced therefrom forwardly therefrom towards block 124. It will also be seen that indicator 144 is shown in a rest position 164 and a position 166 displaced therefrom forwardly towards block 124. The movement between the rest and displaced positions is caused by the aforementioned strike of a golf club head 12 upon target 14. The indicator 144 is thus freely slidable along the platform 132 from a distance indicator rest position 164 to a distance indicator displaced position 166 in response to the sliding motion of the sliding block, the sliding block 122 carrying indicator 144 therewith from its rest position its displaced position. Biasing means or spring 128 then expands to return block 122 to its rest position 126. Indicator 144 remains in its displaced position, however, until moved back to its rest position since it is not attached to either block 122 nor spring 128. This enables the golfer to have a chance to determine distance after completing a swing rather than trying to view the distance during a follow-through, the latter being detrimental to proper golf stroke motions.

As with golf aid 10 previously described, golf aid 100 provides a directional indication of a hit golf ball due to the rotational freedom of support 18 relative to platform 130. Similarly, the aid 100 will indicate to the golfer whether he has struck the target 14 so as to hook or slice a real golf ball. Golf aid 100 also provides an auditory signal like golf aid 10. Aids 10 and 100 are both readily portable. Aid 100, for example, can be attached to a mat 112 having an area of only several square feet. It can be easily rolled up into a roll if desired and carded with one are by the golfer. With a suitably tall ceiling, golf aid 100 can be used year round indoors, thereby providing practice opportunities year round. Golf aid 100 does provide a distance indication that golf aid 10 does not.

The present invention having thus been described, other modifications, alterations, or substitutions may now suggest themselves to those skilled in the art, all of which are within the spirit and scope of the present invention. For example, while blocks 122 and 124 are shown as having "block-like" forms, other configurations are within the scope of the present invention. Block 124 could take the simple form of a substantially rigid, thin, planar upright member. It is therefore intended that the present invention be limited only by the scope of the attached claims below.

What is claimed is:

1. Apparatus for improving a golfer's skill at playing golf, said apparatus being positioned on a surface and comprising:

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club; and means for providing an auditory signal indicating when said target has been properly struck by a golfer with a golf club, wherein said auditory signal means is disposed on said target and said auditory signal means includes an aperture located substantially in the center of said target, wherein when a golf club properly strikes said target air is forced through said aperture, thereby creating an auditory signal.

2. The apparatus of claim 1 wherein said target has a disk shaped configuration.

3. The apparatus of claim 1 and further including means for indicating direction of travel.

4. Apparatus for improving a golfer's skill at playing golf, said apparatus being positioned on a surface and comprising:

a golf ball simulating target, said target having a substantially circular configuration having a diameter substantially equal to the diameter of a golf ball;

means for supporting said target, in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club;

means for providing an auditory signal indicating when said target has been properly struck by a golfer with a golf club; and means for indicating direction of travel comprising means for anchoring said apparatus to the surface such that said supporting means is free to rotate about a predetermined pivot point from said rest position to a rotated displaced position upon said target being struck by a golf club, wherein said rotated displaced position indicates direction of travel.

5. The apparatus of claim 4 wherein said means for anchoring comprises a stake extending through said second arm and the surface, said means for supporting being free to rotate about the stake.

6. The apparatus of claim 4 wherein said means for anchoring comprises a stake extending through said second arm and the surface, said stake defining said pivot point and being free to rotate thereabout.

7. The apparatus of claim 6 wherein said stake rotates in conjunction with said means for supporting.

8. The apparatus of claim 6 wherein said means for anchoring includes a sleeve, said stake being received by said sleeve.

9. Apparatus for improving a golfer's skill at playing golf, said apparatus being surface and comprising:

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club; and means for indicating direction of travel comprising means for anchoring said apparatus to the surface such that said apparatus is free to rotate about a predetermined pivot point upon said target being struck by a golf club.

10. The apparatus of claim 9 wherein said means for anchoring comprises a stake extending through said second arm and the surface, said apparatus being free to rotate about the stake.

11. Apparatus for improving a golfer's skill at playing golf, said apparatus being positioned on a surface and comprising:

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club;

a mounting plate, said plate extending longitudinally away from said target in the direction of movement of said target from said rest position to said displaced position;

means for indicating distance of travel, including:

a slide frame;

a sliding member slidably received by said slide frame and movable between a sliding member rest position and a sliding member displaced position, said sliding member being disposed relative to said target such that when said sliding member is in said sliding member rest position said sliding member can be struck by said target when said target is moved from said target rest position to said target displaced position;

means for biasing said sliding member in said sliding member rest position;

a distance scale disposed longitudinally along said slide frame, and a distance indicator, said distance indicator being freely slidable along said slide frame from a distance indicator rest position to a distance indicator displaced position in response to sliding motion of said sliding member;

wherein striking said target with a golf club will cause said target to be moved from said target rest position to said target displaced position thereby causing said target to engage said sliding member and moving said sliding member from said sliding member rest position to said sliding member displaced position, said sliding member carrying said distance indicator therewith from said distance indicator rest position to said distance indicator displaced position.

12. The apparatus of claim 11 wherein said biasing means returns said sliding member to said sliding member rest position from said sliding member displaced position and said distance indicator remains in said distance indicator displaced position, said distance indicator displaced position lying along said distance scale, whereby said distance indicator provides an indication of the distance that a real golf ball would travel if it had been struck.

13. Apparatus for improving a golfer's skill at playing golf, said apparatus being positioned on a surface and comprising:

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club;

wherein said target and said first and second arms are formed from a single piece of material having said shape memory retention properties such that when said target is struck, said target and said first arm will be displaced from a rest position to a displaced position by pivoting about their hinged attachment to said second arm and will then return from said displaced position to said rest position to be disposed to be struck subsequently; and auditory indication means for indicating when said target has been properly struck by a golfer with a golf club, wherein said auditory indication means is disposed on said target and said auditory indication means includes an aperture located substantially in the center of said target, wherein when a golf club properly strikes said target air is forced through said aperture, thereby creating an auditory signal.

14. Apparatus for improving a golfer's skill at playing golf, said apparatus being positioned on a surface and comprising;

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club;

wherein said target and said first and second arms are formed from a single piece of material having said shape memory retention properties such that when said target is struck, said target and said first arm will be displaced from a rest position to a displaced position by pivoting about their hinged attachment to said second arm and will then return from said displaced position to said rest position to be disposed to be struck subsequently; and means for indicating direction of travel comprising:

means for anchoring said apparatus to the surface such that said means for supporting is free to rotate about a predetermined pivot point upon said target being struck by a golf club.

15. The apparatus of claim 14 wherein said means for anchoring comprises a stake extending through said second arm and the surface, said means for supporting being free to rotate about the stake.

16. Apparatus for improving a golfer's skill at playing golf, said apparatus being positioned on a surface and comprising:

a golf ball simulating target, said target having a substantially circular configuration having a diameter substantially equal to the diameter of a golf ball;

means for supporting said target in a substantially upright orientation, said means for supporting including first and second arms disposed substantially at a right angle to each other, said second arm being disposed substantially flush with the surface and said first arm extending away from the surface and supporting said target away therefrom, said first and second arms being joined at a flexible hinge such that upon said target being struck by a golf club said target will be moved from a rest position to a displaced position, said means for supporting being formed of a material having shape memory retention properties such that said target will return to said rest position from said displaced position after being struck by a golf club;

a mounting plate extending longitudinally away from said target in the direction of movement of said target from said rest position to said displaced position; and means for indicating distance of travel, including:

a slide frame;

a sliding member slidably received by said slide frame and movable between a sliding member rest position and a sliding member displaced position, said sliding member being disposed relative to said target such that when said sliding member is in said sliding member rest position said sliding member can be struck by said target when said target is moved from said target rest position to said target displaced position;

means for biasing said sliding member in said sliding member rest position;

a distance scale disposed longitudinally along said slide frame; and a distance indicator, said distance indicator being freely slidable along said slide frame from a distance indicator rest position to a distance indicator displaced position in response to sliding motion of said sliding member;

wherein striking said target with a golf club will cause said target to be moved from said target rest position to said target displaced position thereby causing said target to engage said sliding member and moving said sliding member from said sliding member rest position to said sliding member displaced position, said sliding member carrying said distance indicator therewith from said distance indicator rest position to said distance indicator displaced position.

17. The apparatus of claim 16 wherein said biasing means returns said sliding member to said sliding member rest position from said sliding member displaced position and said distance indicator remains in said distance indicator displaced position, said distance indicator displaced position lying along said distance scale, whereby said distance indicator provides an indication of the distance that a real golf ball would travel if it had been struck.

* * * * *